US009303948B2

(12) United States Patent
Freed

(10) Patent No.: US 9,303,948 B2
(45) Date of Patent: Apr. 5, 2016

(54) ELASTOMERIC GRIP EXTENDER

(75) Inventor: Robert Freed, Ojai, CA (US)

(73) Assignee: Freed Designs, Inc., Ojai, CA (US)

( * ) Notice: Subject to any disclaimer, the term of this patent is extended or adjusted under 35 U.S.C. 154(b) by 0 days.

(21) Appl. No.: 12/930,814

(22) Filed: Jan. 18, 2011

(65) Prior Publication Data

US 2012/0167430 A1 Jul. 5, 2012

Related U.S. Application Data

(60) Provisional application No. 61/336,409, filed on Jan. 20, 2010.

(51) Int. Cl.
*F41C 23/10* (2006.01)
*F41A 9/65* (2006.01)
*F41C 23/14* (2006.01)

(52) U.S. Cl.
CPC . *F41C 23/10* (2013.01); *F41A 9/65* (2013.01); *F41C 23/14* (2013.01)

(58) Field of Classification Search
CPC ..... F41C 23/10; F41C 23/12; F41C 23/06; F41C 23/14; F41C 23/22; F41C 23/18; F41C 27/00; F41A 17/38
USPC ..... 42/7, 71.02, 90, 71.01, 72, 73, 74, 85; 89/1.42
See application file for complete search history.

(56) References Cited

U.S. PATENT DOCUMENTS

| | | | | | |
|---|---|---|---|---|---|
| 4,343,107 | A * | 8/1982 | Kaltenegger | 42/7 |
| 4,862,619 | A * | 9/1989 | Baldus et al. | 42/7 |
| 5,341,586 | A * | 8/1994 | Aluotto et al. | 42/7 |
| D351,448 | S * | 10/1994 | Fisher | D22/108 |
| D354,110 | S * | 1/1995 | Scott et al. | D22/108 |
| 5,526,600 | A * | 6/1996 | Chesnut et al. | 42/50 |
| 5,584,136 | A * | 12/1996 | Boland et al. | 42/7 |
| 6,557,287 | B2 * | 5/2003 | Wollmann | 42/50 |
| D487,790 | S * | 3/2004 | Freed | D22/108 |
| D487,791 | S * | 3/2004 | Freed | D22/108 |
| 6,928,764 | B2 * | 8/2005 | Freed | 42/71.02 |
| 7,117,622 | B2 * | 10/2006 | Freed et al. | 42/7 |
| 7,191,556 | B2 * | 3/2007 | Pikielny | 42/7 |
| 7,823,312 | B2 * | 11/2010 | Faifer | 42/49.02 |
| 8,215,047 | B2 * | 7/2012 | Ash et al. | 42/72 |
| 2004/0031181 | A1 * | 2/2004 | Freed | 42/71.02 |
| 2006/0130386 | A1 * | 6/2006 | Pikielny | 42/85 |
| 2010/0325932 | A1 * | 12/2010 | Zukowski et al. | 42/6 |
| 2011/0146127 | A1 * | 6/2011 | Metzger | 42/7 |
| 2011/0167698 | A1 * | 7/2011 | Hoguc | 42/71.02 |
| 2011/0289812 | A1 * | 12/2011 | Losinger | 42/72 |
| 2013/0139426 | A1 * | 6/2013 | Baxley | 42/71.02 |

* cited by examiner

*Primary Examiner* — Bret Hayes
*Assistant Examiner* — Derrick Morgan
(74) *Attorney, Agent, or Firm* — James L Davison

(57) ABSTRACT

An extended cartridge magazine longer than a pistol grip length needs to have the gap between the base plate of the magazine and the butt end of the grip filled. The present invention provides a sleeve to fill this gap that can be easily slid on and off the magazine by applying simple pressure to the ends of the sleeve.

1 Claim, 3 Drawing Sheets

ELASTOMERIC GRIP EXTENDER

CROSS-REFERENCE TO RELATED APPLICATIONS

This application is entitled to the benefit of Provisional Application Ser. No. 61/336,409 filed Jan. 20, 2010.

BACKGROUND FIELD

This application is in the field of magazine extenders for the use in handguns. Many modern automatic handguns are designed to be of a compact size. Reducing the length of the grip is one of the ways to reduce the size of the weapon. However, the consequences of a shorter grip are to reduce the user's hand grip on the gun and decrease the gun's firing capacity. A shorter grip requires a shorter magazine that holds fewer cartridges. The magazine that carries the cartridges slides into the handgun's grip through an opening at its base. In those cases where the handgun's user desires a compact handgun with a longer magazine (also called an extended magazine), capable of carrying more cartridges there is the problem of the extended magazine protruding past the base of the handgun's grip, resulting in a gap. This excess magazine length causes a number of potential problems to arise. One is that the resulting gap between the base of the grip and the endplate of the magazine can cause the handgun to snag as the handgun is put into use. Another problem is that this gap can allow moisture, dirt and other foreign material to enter the grip causing rust and possible jamming of the handgun. A third problem is that the metal guides at the top of the extended magazine may bend or buckle if inserted with excess force, which may prevent the cartridges from passing into the chamber for firing. A fourth problem is the loss of ergonometric control of the handgun when held in the firing position. When the handgun user's lower fingers are uncomfortably situated in the gap between the magazine endplate and the grip's base, the tendency is to try to move the user's lower fingers higher or lower.

BACKGROUND EARLIER ART

Many types of designs have been developed to fill the gap between an extended magazine and a handgun's grip. Many of these have included adding mechanical parts to the magazine to fill the gap between the extended (longer) magazine and the shorter grip length, Baldus, U.S. Pat. No. 4,862,619 (1989) is typical of these types of designs. These extra parts add mechanical complexity to the magazine, add weight to the handgun, and may take a long time to add to the magazine and are not easily transferable from one magazine to another. Another type of grip extender is the type that slips over the extended magazine using a slip fit or tight fit, Pikielny, U.S. Pat. No. 7,191,556 (2007). Pikielny ('566) does not teach how the sleeve achieves the tight or loose fit and teaches that the front and back straps and side panels are configured to substantially match an outer contour of a grip of a given manufacturer's handgun. The problem with the loose fit is the sleeve coming off the magazine when the magazine is not inserted into the pistol. The problem with the tight fit is the difficulty in sliding the sleeve on and off the magazine.

SUMMARY

The preferred embodiment of this device precisely controls the height of the presently described grip extender to ensure that, when installed on an extended magazine, it allows the magazine to be inserted inky the handgun grip far enough to ensure a smooth chambering action of cartridge into the firing chamber but physically prevents an over-insertion force from being exerted. An over-insertion force on an extended magazine can result in catastrophic failure of the handgun. An over-insertion force may be applied due to ignorance of the handgun user, high stress on the handgun user when installing the extended magazine or even a drop of the handgun onto a hard surface with the resulting impact jamming the extended magazine into the grip. The present invention securely grips the magazine, yet when squeezed by the fingers. deforms to the extent that removal is easy

DESCRIPTION

The grip extender can possess a surface finish that matches the handgun's grip surface finish and can have a finger groove appearance that extends and complements the design components of the handgun.

A unique feature of this grip is the quality of the elastomeric that it is composed of. Instead of a mechanical attachment method of the many current designs on the market, the present invention uses a deformable material that can be manipulated by the fingers of the user to alter its shape resulting in a conformation that allows it, when distorted, to slip over the magazine upon which it is to be used, and to grip the magazine when the external finger forces are removed thereby un-distorting the grip extender. This distortion is aided by the hollow cup, FIG. 2A 104, on the rear panel of the grip extender. The hollow cup allows the side panels, FIG. 2A 201 to distort outward more than the end panels, FIG. 2A 202, to move inward. This permits the grip extender to be mounted and dismounted on the magazine without the use of tools.

The extended magazine 102 has an open end where cartridges are inserted and a closed end with a base plate. The base plate has a thin rim 101 around its periphery, FIG. 1. The grip extender 103 is slid down from the open end of the magazine and stops when the grip extender is butted up against that rim.

Figure 1:
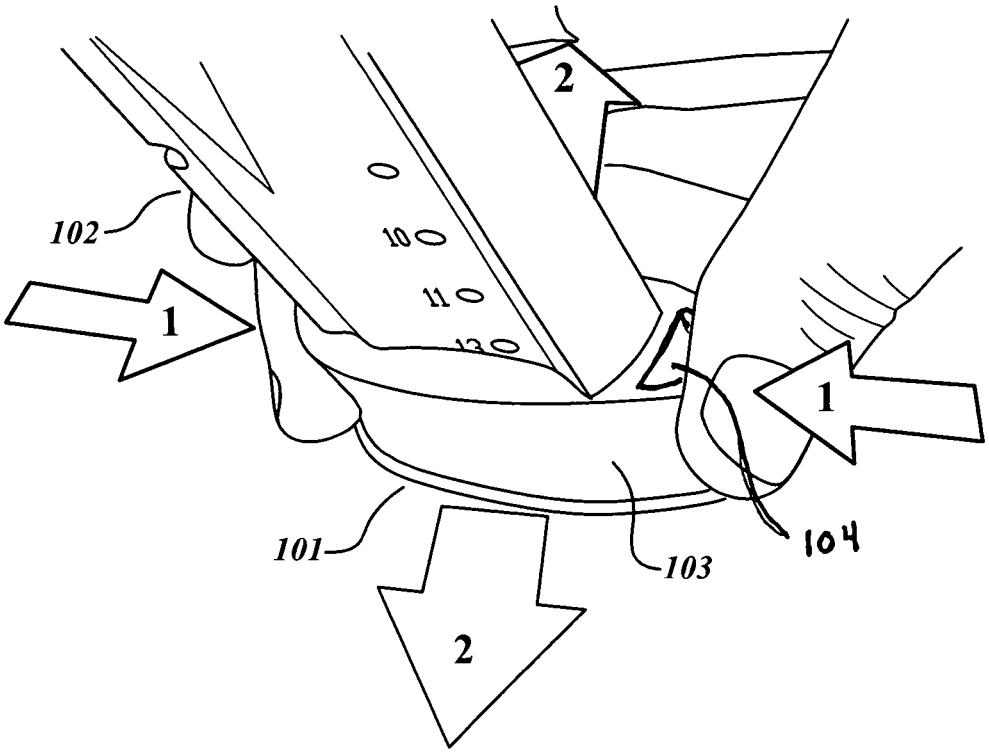
FIG. 1 shows the end caps being squeezed opening side panels to open.

FIG. 1 shows the fingers deforming the grip extender by squeezing the hollow cup 104 allowing said grip extender to slide down the handgun magazine until reaching contact with the magazine end plate.

Figure 2A:
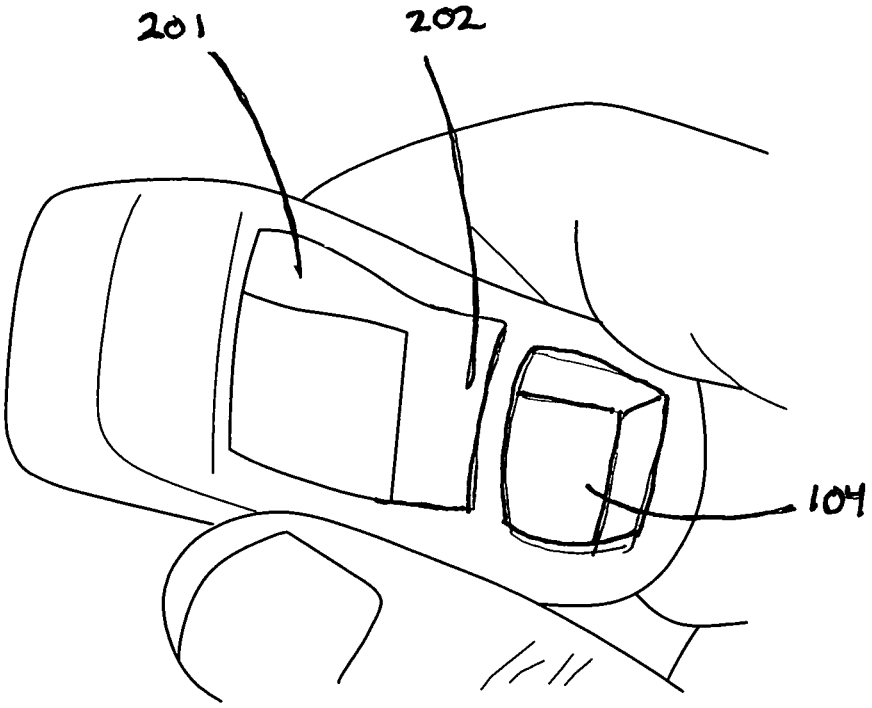
FIG. 2A shows the hollow cup on the end of the grip extender.

FIG. 2*a* more clearly shows the hollow cup 104.

Figure 2B:
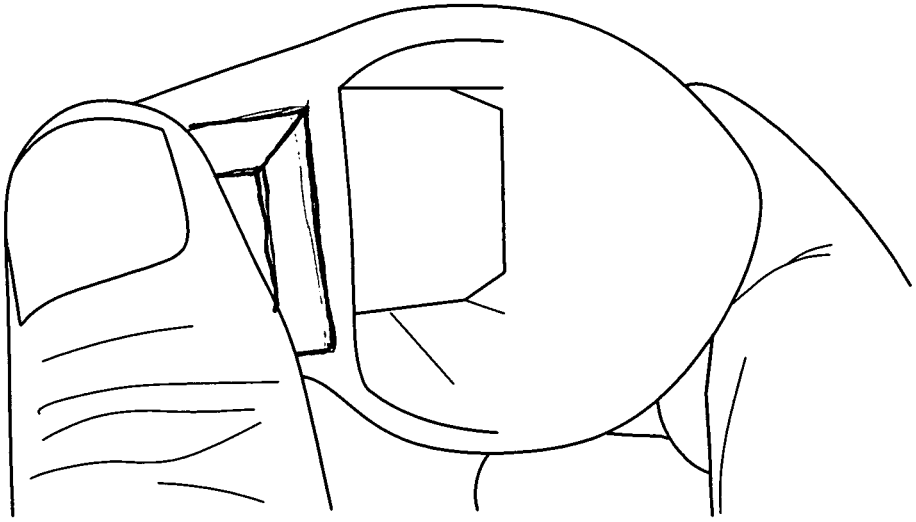
FIG. 2*b* shows pressure placed on the ends of the extender causing sides to open.

FIG. 2*b* shows the deformation that occurs when the end surfaces are squeezed.

Although the description above contains much specificity, these should not be construed as limiting the scope of the embodiments but as merely providing illustrations of some of several embodiments. Changes in the details may be made within the spirit and the scope of the invention, said spirit and scope to be construed broadly and not to be limited except by the character of the claims appended hereto.

I claim:

1. An elastomeric grip extender comprising two smooth sided cavities; a main cavity with two side walls and two end walls, said main cavity walls sized to enclose and capture a pistol magazine, said magazine with an open cartridge insertion end and a closed butt plate end; and an adjoining smaller cup shaped cavity also with two side walls and two end walls, with one of said end walls shared with the main cavity; that when pressure is exerted on the non-shared end wall of the smaller cup shaped cavity the shape of the main cavity sidewalls distorts to the extent that permits said grip extender to be slidably installed from the open end of the pistol magazine and be seated against the butt plate on the closed end of the magazine thereby negating the necessity of removing the butt plate in order to install said grip extender.

* * * * *